US010928156B2

(12) United States Patent
Romero

(10) Patent No.: US 10,928,156 B2
(45) Date of Patent: Feb. 23, 2021

(54) LIMB POCKET ASSEMBLY FOR AN ARCHERY BOW

(71) Applicant: Martin Outdoors, LLC, Walla Walla, WA (US)

(72) Inventor: Scott Romero, Newport, NC (US)

(73) Assignee: Martin Outdoors, LLC, Walla Walla, WA (US)

( * ) Notice: Subject to any disclaimer, the term of this patent is extended or adjusted under 35 U.S.C. 154(b) by 0 days.

(21) Appl. No.: 16/671,517

(22) Filed: Nov. 1, 2019

(65) Prior Publication Data

US 2020/0141687 A1 May 7, 2020

Related U.S. Application Data

(60) Provisional application No. 62/754,570, filed on Nov. 1, 2018.

(51) Int. Cl.

| | |
|---|---|
| ***F41B 5/00*** | (2006.01) |
| ***F41B 5/10*** | (2006.01) |
| ***F41B 5/12*** | (2006.01) |
| ***F41B 5/14*** | (2006.01) |

(52) U.S. Cl.
CPC ..... *F41B 5/1403* (2013.01); *F41B 5/10* (2013.01)

(58) Field of Classification Search
CPC .. F41B 5/1403; F41B 5/10; F41B 5/00; F41B 5/12; F41B 5/123
USPC ..... 124/23.1, 25, 25.6
See application file for complete search history.

(56) References Cited

U.S. PATENT DOCUMENTS

| | | | | |
|---|---|---|---|---|
| 3,486,495 | A * | 12/1969 | Allen | F41B 5/10 124/25.6 |
| 5,429,106 | A * | 7/1995 | Martin | F41B 5/0026 124/23.1 |
| 9,581,406 | B1 * | 2/2017 | Nevels | F41B 5/1403 |
| 2012/0192843 | A1 * | 8/2012 | Batdorf | F41B 5/10 124/25.6 |
| 2013/0192573 | A1 * | 8/2013 | McPherson | F41B 5/14 124/23.1 |
| 2015/0226511 | A1 * | 8/2015 | Chang | F41B 5/1403 124/23.1 |
| 2016/0102937 | A1 * | 4/2016 | Ell | F41B 5/1403 124/25.6 |

* cited by examiner

*Primary Examiner* — John E Simms, Jr.
(74) *Attorney, Agent, or Firm* — Mark A. Pitchford; Eric B. Fugett; Pitchford Fugett, PLLC

(57) ABSTRACT

An improved archery bow includes an improved limb pocket assembly. When properly assembled, the limb pocket assembly includes a generally rectangular pocket body, at least one elongated bow limb, and at least one cylindrical fastener for aligning and securing the limb within the pocket body. When fully assembled, a limb screw positions the limb pocket assembly on the riser and secures the limb pocket to the riser of the archery bow. The limb pocket assembly disclosed herein substantially eliminates movement or shifting of the limbs within the pocket while shooting the bow and between shots, thereby providing a user with increased accuracy while shooting the bow.

16 Claims, 3 Drawing Sheets

LIMB POCKET ASSEMBLY FOR AN ARCHERY BOW

CROSS-REFERENCES TO RELATED APPLICATIONS

This application claims priority to and hereby incorporates in its entirety U.S. Provisional Patent Application No. 62/754,570 entitled "LIMB POCKET ASSEMBLY FOR AN ARCHERY BOW" filed on Nov. 1, 2018.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to the field of archery. More specifically, the present invention relates to an improved limb pocket assembly for an archery bow.

In most modern compound bows, an assembly known as a "limb pocket" is used to secure each limb of the bow to a riser of the bow at opposing ends of the riser. A major drawback of currently available limb pockets is that they permit the limbs to move and shift within the pocket during operation of the bow, which negatively effects accuracy while shooting the bow. This is particularly true for split limb bow designs. Accordingly, what is needed are improvements in archery bows.

BRIEF SUMMARY OF THE INVENTION

Aspects of the present invention provide an improved archery bow includes an improved limb pocket assembly. When properly assembled, the limb pocket assembly includes a generally rectangular pocket body, at least one elongated bow limb, and at least one cylindrical fastener for aligning and securing the limb within the pocket body. When fully assembled, a limb screw positions the limb pocket assembly on the riser and secures the limb pocket to the riser of the archery bow. The limb pocket assembly disclosed herein substantially eliminates movement or shifting of the limbs within the pocket while shooting the bow and between shots, thereby providing a user with increased accuracy while shooting the bow.

In one aspect, a limb pocket body for an archery bow includes a channel, a limb screw, and a lateral hole. The channel is recessed into a lower surface of the body. The channel is configured to receive a limb and of a limb such that the limb received therein extends rearward when the limb pocket body is in the upright position and installed on a riser of the archery bow. The limb screw hole extends generally vertically through the limb pocket body when the limb pocket body is in an upright position. The limb screw hole is configured to receive a riser screw. The riser screw secures the limb pocket body to a first end of the riser when the riser screw is installed in the limb pocket body and riser. The lateral hole extends inwardly from the channel. The lateral hole is configured to threadingly engage a cylindrical fastener to align the limb in within the channel. The lateral hole extends generally horizontally when the limb pocket body is in the upright position.

In another embodiment, a limb pocket assembly includes a limb pocket body for an archery bow and a cylindrical fastener. The limb pocket body for an archery bow includes a channel, a limb screw, and a lateral hole. The channel is recessed into a lower surface of the body. The channel is configured to receive a limb and of a limb such that the limb received therein extends rearward when the limb pocket body is in the upright position and installed on a riser of the archery bow. The limb screw hole extends generally vertically through the limb pocket body when the limb pocket body is in an upright position. The limb screw hole is configured to receive a riser screw. The riser screw secures the limb pocket body to a first end of the riser when the riser screw is installed in the limb pocket body and riser. The lateral hole extends inwardly from the channel. The lateral hole is configured to threadingly engage the cylindrical fastener to align the limb in within the channel. The lateral hole extends generally horizontally when the limb pocket body is in the upright position.

In another aspect, and archery bow includes a limb pocket assembly, a riser, a bowstring, a cam system, and a limb. The limb pocket assembly includes a limb pocket body for an archery bow and a cylindrical fastener. The limb pocket body for an archery bow includes a channel, a limb screw, and a lateral hole. The channel is recessed into a lower surface of the body. The channel is configured to receive a limb and of a limb such that the limb received therein extends rearward when the limb pocket body is in the upright position and installed on a riser of the archery bow. The limb screw hole extends generally vertically through the limb pocket body when the limb pocket body is in an upright position. The limb screw hole is configured to receive a riser screw. The riser screw secures the limb pocket body to a first end of the riser when the riser screw is installed in the limb pocket body and riser. The lateral hole extends inwardly from the channel. The lateral hole is configured to threadingly engage the cylindrical fastener to align the limb in within the channel. The lateral hole extends generally horizontally when the limb pocket body is in the upright position. The riser is configured to receive the riser screw to secure the limb pocket assembly thereto. The cam system is configured to receive the bowstring and to secure to the limb opposite the limb pocket body. The limb is configured to connect between the limb pocket body and the cam system to support the cam system.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
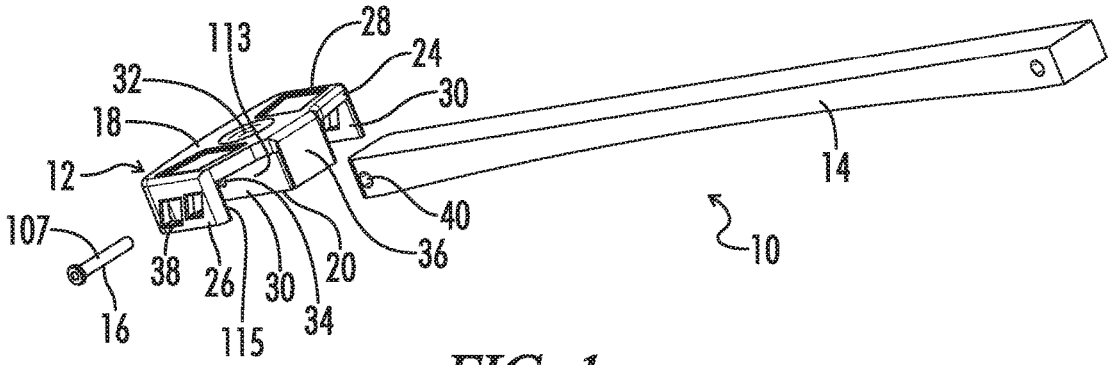
FIG. 1 is an exploded isometric view of a limb pocket assembly for an archery bow showing a bow limb positioned for insertion into a channel defined in the body of the limb pocket, and a cylindrical fastener positioned for insertion through the limb into the limb pocket body to align and retain the limb in the channel according to one embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of a modern compound archery bow is when held by a user in a vertical orientation ready to draw and/or release. The upright position of the limb pocket assembly is when installed at a top end of a riser of a compound bow. It is contemplated within the scope of the claims that top and bottom and left and right would be reversed for the limb pocket assembly at the lower end of the riser. As used herein, archery bow refers to modern compound single limb or split limb bows or a compound crossbow. The upright position of a crossbow as described herein is when held by a user generally vertically (i.e., sideways) such that one limb pocket assembly is the upper limb pocket assembly and a limb pocket assembly attached to the opposing end of a riser of the crossbow is the lower limb pocket assembly. It is contemplated within the scope of the claims that top and bottom and left and right would be reversed for the limb pocket assembly at the lower end of the riser. The upper and lower limb pocket assemblies can be interchanged on archery bows (i.e., bows and crossbows) such that orientations are simply reversed (except front to back) for upper and lower limb pocket assemblies. Forward is generally the direction in which a projectile is propelled from the archery bow when shot, and rearward is generally toward a user shooting the archery bow. Vertical, horizontal, above, below, side, top, bottom and other orientation terms are described with respect to this upright position and with respect to the upper limb pocket assembly during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring to FIGS. 1-6, one embodiment of a limb pocket assembly 10 for an archery bow 100 is shown. The limb pocket assembly 10 includes a generally rectangular limb pocket body 12 and at least one cylindrical fastener 16 for aligning and securing a limb 14 within the pocket body 12. In some embodiments, the limb pocket assembly 10 also includes a limb screw or riser screw 103 for securing the limb pocket assembly 10 to a riser 105 of an archery bow 100.

The limb pocket body 12 for the archery bow 100 includes a channel 30, a limb screw hole 32, and a lateral hole 34. The channel 30 is recessed into a lower surface 20 of the body 12. The channel 30 is configured to receive a limb and of a limb 14 such that the limb 14 received there and extends rearward when the limb pocket body 12 is in the upright position and installed on the riser 105 of the archery bow 100. The limb screw hole 32 extends generally vertically through the limb pocket body 12 when the limb pocket body 12 is in the upright position. The limb screw hole 32 is configured to receive the limb screw or riser screw 103. The riser screw 103 secures the limb pocket body 12 to a first end of the riser 105 when the riser screw 103 is installed in the limb pocket body 12 and riser 105. The lateral hole 34 extends inwardly from the channel 30 into a central portion 36 of the limb pocket body 12. The lateral hole 34 is configured to threateningly engage the cylindrical fastener 16 to align the limb and of the limb 14 within the channel 30. The lateral hole 34 extends generally horizontally when the limb pocket body 12 is in the upright position.

In one embodiment, the limb pocket body 12 further includes a slot 38 through a side of the limb pocket body 12, the side defining an outer wall 115 of the channel 30. The slot 38 is configured to receive the cylindrical fastener 16 therethrough. In one embodiment, the slot 38 is sized to match a barrel 16 of the cylindrical fastener 16 such that the cylindrical fastener 16 is held in a double shear arrangement via the slot 38 in the outer wall 115 of the channel 30 and the lateral hole 34 when the cylindrical fastener 16 is properly assembled in the limb pocket body 12. In one embodiment, the slot 38 and lateral hole 34 are forward of the limb screw hole 32.

In one embodiment, the channel 30 is narrower near an upper surface 18 of the limb pocket body 12 and at a lower surface 20 of the limb pocket body 12. In one embodiment, an inner wall 113 of the channel 30 extends generally vertically when the limb pocket body 12 is in the upright position. In this embodiment, the outer wall 115 of the channel 30 opposite the inner wall 113 of the channel 30 is closer to the inner wall 113 near the upper surface 18 than at the lower surface 20 of the limb pocket body 12. This narrowing channel serves to keep the limbs 14 aligned along the inner wall 113 of the pocket body 12 to increase accuracy of the archery bow 100.

In one embodiment, the channel 30 is a first channel at a right side 28 of the limb pocket body 12 when the limb pocket body 12 is in the upright position (and installed on an upper end of the riser 105). The limb screw hole 32 centered right to left within a central portion 36 of the limb pocket body 12 when the limb pocket body 12 is in the upright position. The limb end is a first limb end, the cylindrical fastener 16 is a first cylindrical fastener, and the lateral hole 34 is a first lateral hole extending right to left when limb pocket body 12 is in the upright position. In one embodiment, the limb pocket body 12 further includes a second channel 30 at a left side 26 of the limb pocket body 12. The second channel 30 is configured to receive a second limb end. The second limb end may be a second limb end of the first limb 14 or a limb end of a second limb. That is, the archery bow 100 may be set up for a single limb at each end of the riser 105, or the archery bow 100 may be set up for dual limbs at either end of the riser 105 (i.e. four limbs total). A second lateral hole 34 extends inwardly from the second channel 30. The second lateral hole 34 is configured to threateningly engage a second cylindrical fastener 16 to align the second limb and within the second channel 30. The lateral hole 34 extends generally horizontally left to right into the central portion 36 of the limb pocket body 12 when the limb pocket body 12 is in the upright position. In one embodiment, the upper surface 18 of the limb pocket body 12 extends further rearward between the first and second channels 30 than at the right side 28 and the left side 26 of the limb pocket body 12. That is, the central portion 36 of the limb pocket body 12 extends further rearward than the left side 26 and right side 28 of the limb pocket body 12.

In one embodiment, an archery bow 100 includes the limb pocket assembly (i.e., limb pocket body 12 and cylindrical retainer 16), the riser 105, the bowstring 130, a cam system 133, and a plurality of limbs 14. The riser 105 is configured to receive the riser screw 103 to secure the limb pocket assembly 10 thereto. The cam system 133 is configured to receive the bowstring 130 and secure to the limb 14 opposite the limb pocket body 12. The limb 14 is configured to connect between the limb pocket body 12 and the cam system 133. In one embodiment, the archery bow 100 further includes a bow sight 150 configured to attach to the riser 105.

In one embodiment, the pocket body 12 includes an upper surface 18, a lower surface 20 opposite the upper surface, a front side 22, a back side 24 opposite the front side, a left side 26, and a right side 28 opposite the left side. Defined in the lower surface 20 is a pair of channels 30 in which a portion (i.e., an end) of a bow limb 14 is receivable. It should be understood that the portion of the bow limb 14 that is receivable in the channels 30 is the end of the bow limb 14 that is opposite the end to which the cam system 133 is attachable. It should also be understood that while the embodiment shown in FIGS. 1-6 is depicted as having a pair of channels 30, in other embodiments, the lower surface 20 may have only a single channel 30. In each embodiment, the channel or channels 30 extend through the back side 24 of the pocket body 12. Additionally, while the embodiment shown in FIGS. 1-6 depicts the front side 22 of the pocket body 12 as being solid, in other embodiments, the channel or channels 30 may extend through the front side 22 of the pocket body 12 in the same way shown for the back side 24 in FIGS. 1-6.

The pocket body 12 also includes a limb screw hole 32 in which the limb screw or riser screw 103 is receivable. The limb screw hole 32 extends through the body 12 from the upper surface 18 to the lower surface 20 at an angle substantially perpendicular to the working surface of the limb 14 when the limb is received in channel 30. The portion of the limb screw hole 32 near the upper surface 18 of the pocket body 12 can also include a countersink or chamfer 34. When the bow limbs 14 are received in the channels 30 as exemplified in FIG. 2, the limb screw 103 can be inserted through the limb screw hole 32 and threaded into a coaxial hole in an underlying riser 105 to secure the pocket body 12 and bow limbs 14 to the riser 105.

Figure 4:
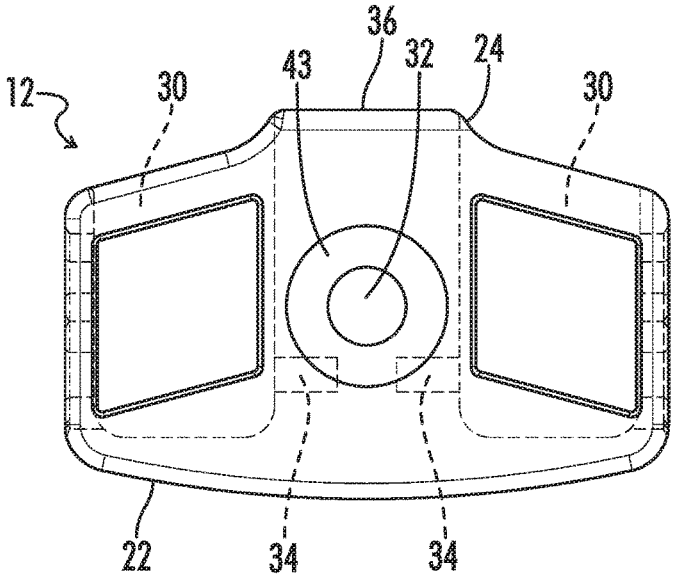
FIG. 4 is a bottom plan view of the limb pocket body of FIG. 3.
Figure 5:
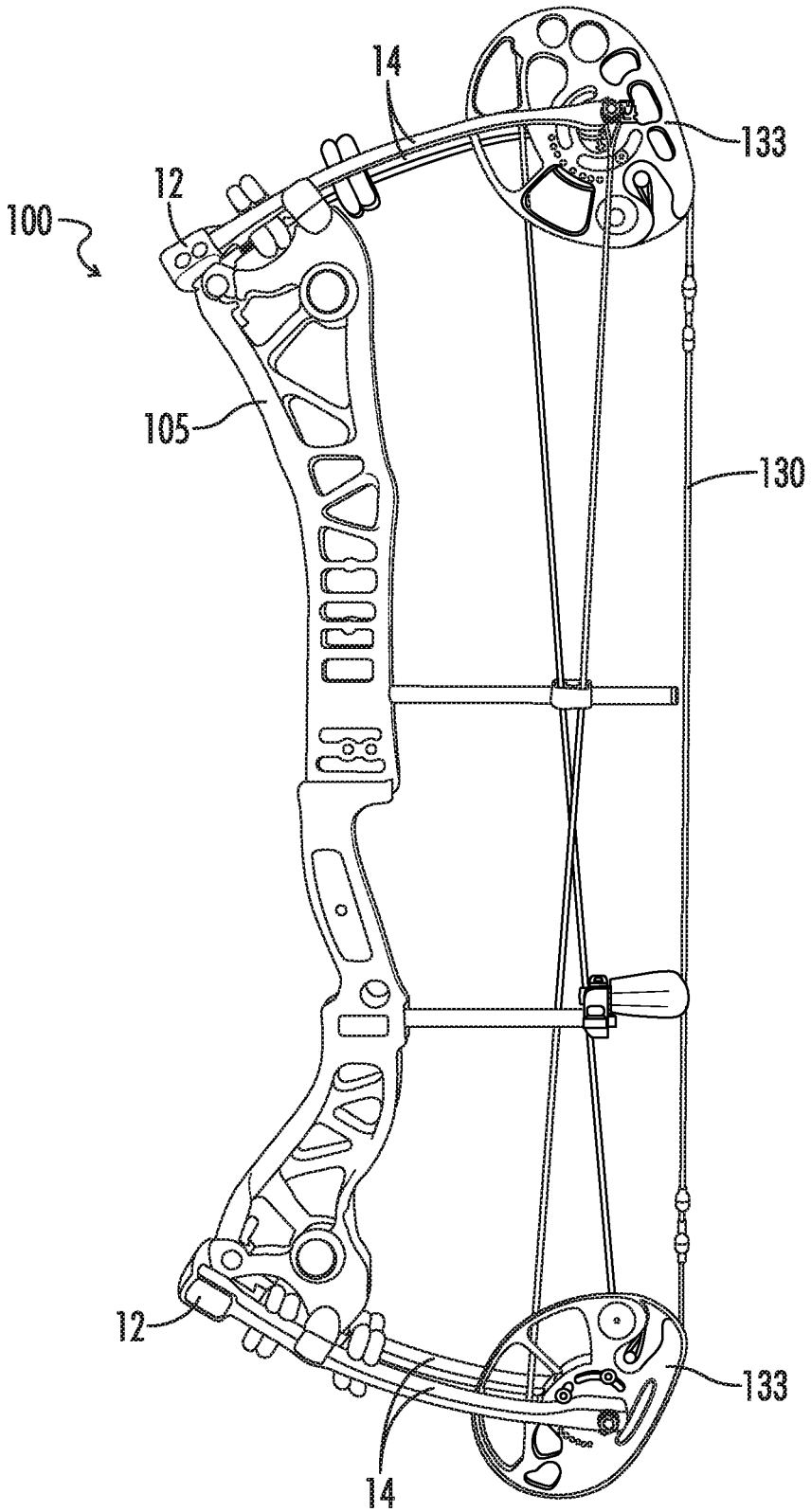
FIG. 5 is a side perspective view of an archery bow including a pair of opposing limb pocket assemblies (as shown in FIG. 1) according to one embodiment of the invention.
Figure 6:
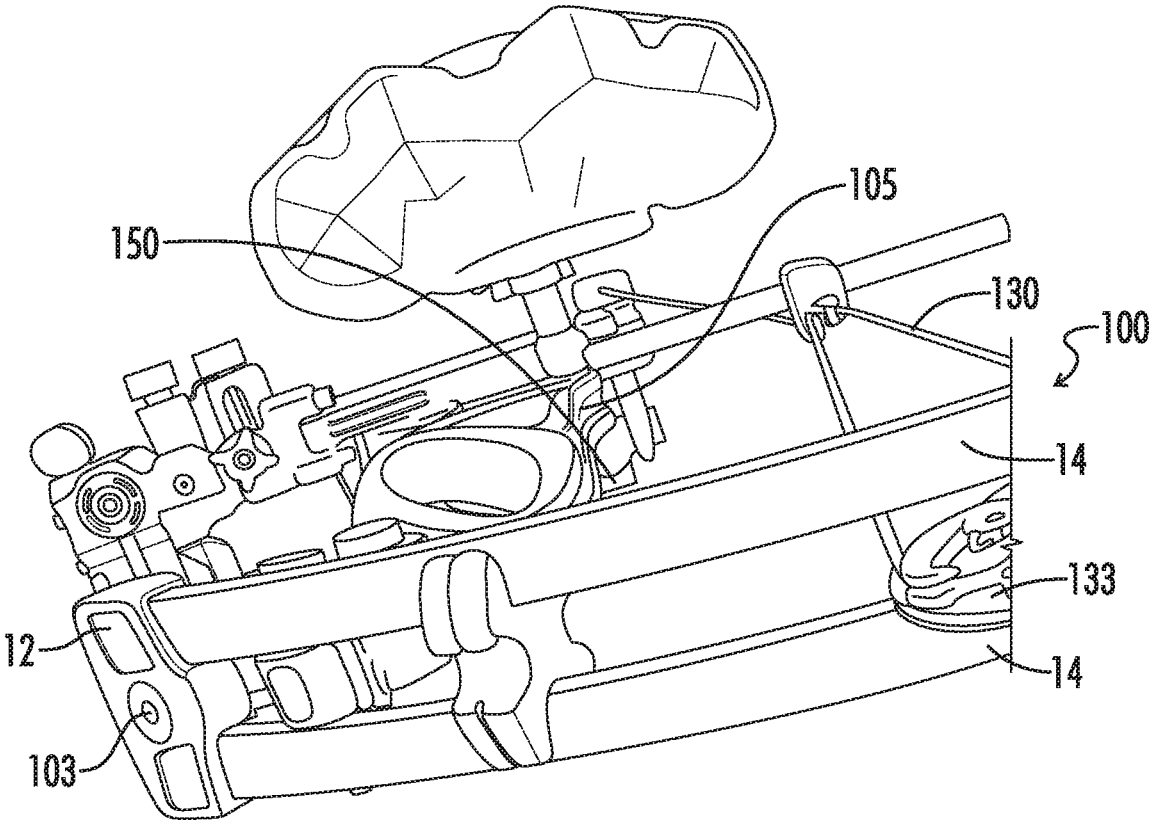
FIG. 6 is a top isometric view of an archer bow including the limb pocket assembly of FIG. 1.

The pocket body 12 also includes at least one lateral hole 34 in which the cylindrical fastener 16 is receivable. The at least one lateral hole 34 extends into at least a portion of the central portion 36 of the body 12 defined by the pair of channels 30, as best shown in FIGS. 1 and 4. In some embodiments, the at least one lateral hole 34 is one lateral hole that extends completely through the central portion 36. In other embodiments, the at least one lateral hole 34 is two opposing lateral holes defined in opposite sides of central portion 36, as shown in FIG. 4. In some embodiments, the lateral hole(s) 34 can be threaded, while in other embodiments, the lateral hole(s) can have a smooth bore. In a smooth bore embodiment, the cylindrical fastener 16 would extend through the pair of limbs 14, and through the central portion 36 of the pocket body 12 and be secured by a fastener at one or both ends of the cylindrical fastener 16.

The left and right sides 26, 28 of the pocket body 12 include one or more slots 38 defined therein. The slots 38 are concentrically aligned with lateral hole 34 in central portion 36 of the pocket body 12.

Additionally, the proximal end of the bow limb 14 that is receivable in the channel 30 is provided with a lateral alignment hole 40 extending through the limb from side to side, as best shown in FIG. 1.

Figure 2:
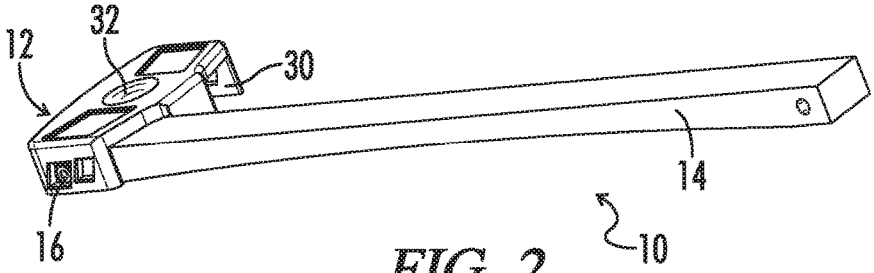
FIG. 2 is an assembled isometric view of the limb pocket assembly of FIG. 1.
Figure 3:
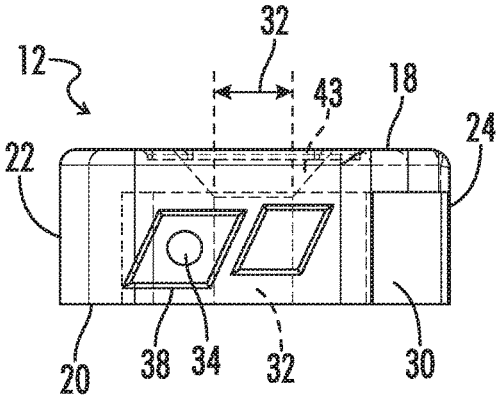
FIG. 3 is a left side perspective view of the limb pocket body shown in FIG. 1.

To assemble the limb pocket assembly 10, the limb 14 is placed in the channel 30 of the pocket body 12 as shown in FIG. 2 and the cylindrical fastener 16 is inserted through the slot 38 in left side 26 of the body, then through the lateral alignment hole 40 in limb 14, and finally into the lateral hole 34 in central portion 36 of pocket body 12 to align and retain the limb 14 within the channel 30. This arrangement closely aligns the limb 14 against the machined surfaces of the channel 30, and thereby simultaneously eliminates limb movement and secures the limb 14 to the pocket body 12.

In the embodiment shown in FIGS. 1-2, the cylindrical fastener 16 is a threaded bolt with a hex socket head. However, in other embodiments, the cylindrical fastener 16 can be a bolt, screw, pin, dowel, or other similar device that can be used to align and retain the limb 14 in the channel 30 of the pocket body 12. It should be noted that slots 38 can be sized to receive the head of the cylindrical fastener 16 so that the head does not protrude beyond the exterior surface of either side 26, 28 of the pocket body 12 when the fastener 16 is received in lateral holes 34 and 40.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful LIMB POCKET ASSEMBLY FOR AN ARCHERY BOW it is not intended that such references be construed as limitations upon the scope of this invention except as set forth in the following claims.

What is claimed is:

1. A limb pocket body for an archery bow, said limb pocket body comprising:

a channel recessed into a lower surface of the body, said channel configured to receive a limb end of a limb such that the limb received therein extends rearward when the limb pocket body is in an upright position and installed on a riser of the archery bow;

a limb screw hole extending generally vertically through the limb pocket body when the limb pocket body is in the upright position, wherein:

the limb screw hole is configured to receive a riser screw; and the riser screw secures the limb pocket body to a first end of the riser when the riser screw is installed in the limb pocket body and riser; and a lateral hole extending inwardly from the channel, said lateral hole configured to engage a cylindrical fastener to align the limb end within the channel, wherein the lateral hole extends generally horizontally when the limb pocket body is in the upright position, wherein:

the limb pocket body further comprises a slot through a side of the limb pocket body, said side defining an outer wall of the channel, wherein:

the slot is configured to receive the cylindrical fastener therethrough;

the slot and lateral hole are forward of a central axis of the limb screw hole, and the channel is a first channel at a right side of the limb pocket body when the limb pocket body is in the upright position, the limb screw hole is centered right to left when the limb pocket body is in the upright position, the limb end is a first limb end, the cylindrical fastener is a first cylindrical fastener, and the lateral hole is a first lateral hole extending right to left when the limb pocket body is in the upright position, and wherein the limb pocket body further comprises:

a second channel at a left side of the limb pocket body, said second channel configured to receive a second limb end; and a second lateral hole extending inwardly from the second channel, said second lateral hole configured to engage a second cylindrical fastener to align the second limb end within the channel, wherein the lateral hole extends generally horizontally left to right into the limb pocket body when the limb pocket body is in the upright position.

2. The limb pocket body of claim 1, wherein:

the slot is sized to match a barrel of the cylindrical fastener such that the cylindrical fastener is held in a double sheer arrangement via the slot in the outer wall of the channel and the lateral hole when the cylindrical fastener is properly assembled in the limb pocket body.

3. The limb pocket body of claim 1, wherein:

the channel is narrower near an upper surface of the limb pocket body than at a lower surface of the limb pocket body.

4. The limb pocket body of claim 1, wherein:

the channel is narrower near an upper surface of the limb pocket body than at a lower surface of the limb pocket body;

an inner wall of the channel is generally vertical when the limb pocket body is in the upright position; and an outer wall of the channel opposite the inner wall of the channel is closer to the inner wall near the upper surface of the limb pocket body than at the lower surface of the limb pocket body.

5. The limb pocket body of claim 1, wherein:

an upper surface of the limb pocket body extends further rearward between the first and second channels than at the right side and the left side of the limb pocket body.

6. A limb pocket assembly comprising:

a limb pocket body for an archery bow, said limb pocket body comprising:

a channel recessed into a lower surface of the body, said channel configured to receive a limb end of a limb such that the limb received therein extends rearward when the limb pocket body is in an upright position and installed on a riser of the archery bow;

a limb screw hole extending generally vertically through the limb pocket body when the limb pocket body is in the upright position, wherein:

the limb screw hole is configured to receive a riser screw; and the riser screw secures the limb pocket body to a first end of the riser when the riser screw is installed in the limb pocket body and riser; and a lateral hole extending inwardly from the channel, said lateral hole configured to engage a cylindrical fastener to align the limb end within the channel, wherein the lateral hole extends generally horizontally when the limb pocket body is in the upright position; and the cylindrical fastener, wherein:

the limb pocket body further comprises a slot through a side of the limb pocket body, said side defining an outer wall of the channel;

the slot is configured to receive the cylindrical fastener therethrough;

the slot and lateral hole are forward of a central axis of the limb screw hole, and the channel is a first channel at a right side of the limb pocket body when the limb pocket body is in the upright position, the limb screw hole is centered right to left when the limb pocket body is in the upright position, the limb end is a first limb end, the cylindrical fastener is a first cylindrical fastener, and the lateral hole is a first lateral hole extending right to left when the limb pocket body is in the upright position, and wherein the limb pocket body further comprises:

a second channel at a left side of the limb pocket body, said second channel configured to receive a second limb end;

a second lateral hole extending inwardly from the second channel, said second lateral hole configured to engage a second cylindrical fastener to align the second limb end within the channel, wherein the lateral hole extends generally horizontally left to right into the limb pocket body when the limb pocket body is in the upright position.

7. The limb pocket assembly of claim 6, wherein:

the limb pocket assembly further comprises the riser screw.

8. The limb pocket assembly of claim 6, wherein:

the slot is sized to match a barrel of the cylindrical fastener such that the cylindrical fastener is held in a double sheer arrangement via the slot in the outer wall of the channel and the lateral hole when the cylindrical fastener is properly assembled in the limb pocket body.

9. The limb pocket assembly of claim 6, wherein:

the channel is narrower near an upper surface of the limb pocket body than at a lower surface of the limb pocket body.

10. The limb pocket assembly of claim 6, wherein:

the channel is narrower near an upper surface of the limb pocket body than at a lower surface of the limb pocket body;

an inner wall of the channel is generally vertical when the limb pocket body is in the upright position.

11. The limb pocket assembly of claim 6, wherein:

an upper surface of the limb pocket body extends further rearward between the first and second channels than at the right side and the left side of the limb pocket body.

12. The limb pocket assembly of claim 6 further comprising the limb.

13. An archery bow comprising:

a limb pocket assembly comprising:

a limb pocket body for an archery bow, said limb pocket body comprising:

a channel recessed into a lower surface of the body, said channel configured to receive a limb end of a limb such that the limb received therein extends rearward when the limb pocket body is in an upright position and installed on a riser of the archery bow;

a limb screw hole extending generally vertically through the limb pocket body when the limb pocket body is in the upright position, wherein:

the limb screw hole is configured to receive a riser screw; and the riser screw secures the limb pocket body to a first end of the riser when the riser screw is installed in the limb pocket body and riser; and a lateral hole extending inwardly from the channel, said lateral hole configured to engage a cylindrical fastener to align the limb end within the channel, wherein the lateral hole extends generally horizontally when the limb pocket body is in the upright position; and the cylindrical fastener, wherein:

the limb pocket body further comprises a slot through a side of the limb pocket body, said side defining an outer wall of the channel, wherein:

the slot is configured to receive the cylindrical fastener therethrough; and the slot and lateral hole are forward of a central axis of the limb screw hole;

the riser configured to receive the riser screw to secure the limb pocket assembly thereto;

a bow string;

a cam system configured to receive the bow string, said cam system configured to secure to the limb opposite the limb pocket body; and the limb configured to connect between the limb pocket body and the cam system, wherein:

the channel is a first channel at a right side of the limb pocket body when the limb pocket body is in the upright position, the limb screw hole is centered right to left when the limb pocket body is in the upright position, the limb end is a first limb end, the cylindrical fastener is a first cylindrical fastener, and the lateral hole is a first lateral hole extending right to left when the limb pocket body is in the upright position, and wherein the limb pocket body further comprises:

a second channel at a left side of the limb pocket body, said second channel configured to receive a second limb end of a second limb;

a second lateral hole extending inwardly from the second channel, said second lateral hole configured to engage a second cylindrical fastener to align the second limb end within the channel, wherein the lateral hole extends generally horizontally left to right into the limb pocket body when the limb pocket body is in the upright position; and the archery bow further comprises the second limb and the second cylindrical faster.

14. The archery bow of claim 13, wherein:

the limb pocket assembly further comprises the riser screw.

15. The archery bow of claim 13, wherein:

the slot is sized to match a barrel of the cylindrical fastener such that the cylindrical fastener is held in a double sheer arrangement via the slot in the outer wall of the channel and the lateral hole when the cylindrical fastener is properly assembled in the limb pocket body.

16. The archery bow of claim 13 wherein:

the limb pocket assembly is a first limb pocket assembly;

the bow further comprises a second limb pocket assembly configured to secure to the riser at a second of the riser opposite the first end of the riser, said second limb pocket assembly being inverted with respect to the first limb pocket assembly when the bow is in the upright position;

the bow further comprises another limb configured to connect between the second limb pocket assembly and the cam system; and a bow sight configured to attach to the riser.

* * * * *